US010463897B2

(12) United States Patent
Dedina et al.

(10) Patent No.: US 10,463,897 B2
(45) Date of Patent: Nov. 5, 2019

(54) DEVICE FOR ANTI-FIRE PROTECTION OF A STARTER-CONTROLLER DEVICE OF AN ELECTRICAL INSTALLATION

(71) Applicant: Schneider Electric Industries SAS, Rueil Malmaison (FR)

(72) Inventors: Gregory Dedina, Vourey (FR); Bernard Loiacono, Seyssins (FR)

(73) Assignee: Schneider Electric Industries SAS, Rueil Malmaison (FR)

( * ) Notice: Subject to any disclaimer, the term of this patent is extended or adjusted under 35 U.S.C. 154(b) by 300 days.

(21) Appl. No.: 14/870,348

(22) Filed: Sep. 30, 2015

(65) Prior Publication Data

US 2016/0101305 A1 Apr. 14, 2016

(30) Foreign Application Priority Data

Oct. 9, 2014 (FR) ..... 14 59703

(51) Int. Cl.
*A62C 3/16* (2006.01)
*A62C 35/02* (2006.01)
(Continued)

(52) U.S. Cl.
CPC ..... *A62C 3/16* (2013.01); *A62C 35/026* (2013.01); *A62C 35/13* (2013.01); *H01H 89/06* (2013.01); *H01H 2071/0292* (2013.01)

(58) Field of Classification Search
CPC ..... A62C 3/16; A62C 35/026; A62C 35/13; A62C 37/40; A62C 3/00; A62C 35/02;
(Continued)

(56) References Cited

U.S. PATENT DOCUMENTS 4,711,307 A 12/1987 Rosen
5,936,531 A * 8/1999 Powers ..... G08B 17/00 169/60
(Continued)

FOREIGN PATENT DOCUMENTS

DE 103 11 556 A1 9/2004
DE 10 2006 048 015 A1 4/2008
(Continued)

OTHER PUBLICATIONS

French Preliminary Search Report dated Jun. 12, 2015 in French Application 14 59703, filed on Oct. 9, 2014 (with English Translation of Categories of Cited Documents).

*Primary Examiner* — Viet Le
*Assistant Examiner* — Juan C Barrera
(74) *Attorney, Agent, or Firm* — Oblon, McClelland, Maier & Neustadt, L.L.P.

(57) ABSTRACT

An anti-fire protection device for a starter-controller device of an electrical installation is able to be connected to an electrical power conductor and includes thermal monitoring of the electrical power conductor to detect a temperature rise of greater than a predetermined threshold. This anti-fire protection device can be fixed mechanically to the starter-controller device via at least one mechanical linking member. The thermal monitoring includes at least one temperature sensor and a cartridge including a fire extinguishing agent and at least one injection element, situated on the same face of the protection device as the temperature sensor, the cartridge being situated inside the protection device and connected to the temperature sensor, the injection element being able to inject the fire extinguishing agent towards the electrical power conductors subsequent to a detection, by the temperature sensor, of a temperature of greater than the predetermined threshold.

9 Claims, 4 Drawing Sheets

(51) Int. Cl.
*A62C 35/13* (2006.01)
*H01H 89/06* (2006.01)
*H01H 71/02* (2006.01)

(58) Field of Classification Search
CPC ..... A62C 37/11; A62C 37/36; A62C 37/44; H01H 89/06; H01H 2071/0292; H02B 13/025; A62D 1/0071; A62D 1/0064; A62D 1/0028; G08B 17/10; G08B 17/117; G08B 17/00; G08B 19/00; G08B 29/145; B64D 2045/009
USPC ..... 169/60, 70, 56, 29; 361/103, 104; 340/289
See application file for complete search history.

(56) References Cited

U.S. PATENT DOCUMENTS 6,104,301 A * 8/2000 Golden ..... A62C 37/40 169/5
6,317,053 B1 * 11/2001 Seeliger ..... A62C 3/00 169/46
2007/0103325 A1 * 5/2007 Wagner ..... A62C 3/16 340/628
2007/0169948 A1 * 7/2007 Vidojevic ..... A62C 3/006 169/65
2008/0190627 A1 * 8/2008 Koelewijn ..... A62C 5/006 169/46
2009/0188682 A1 * 7/2009 Gensel ..... A62C 3/16 169/46
2013/0120102 A1 * 5/2013 Barna ..... A62C 37/36 337/298
2013/0264073 A1 * 10/2013 Ling ..... A62C 3/07 169/46
2014/0168845 A1 6/2014 Charles
2014/0186668 A1 * 7/2014 Jung ..... A62C 3/16 429/61
2014/0196917 A1 * 7/2014 Botter ..... A62C 99/0018 169/45

FOREIGN PATENT DOCUMENTS

FR 2 979 149 A1 2/2013
GB 2 163 954 A 3/1986

* cited by examiner

DEVICE FOR ANTI-FIRE PROTECTION OF A STARTER-CONTROLLER DEVICE OF AN ELECTRICAL INSTALLATION

The present invention concerns an anti-fire protection device for a starter-controller device of an electrical installation, the starter-controller device being adapted to be connected to an electrical power conductor.

It also concerns an associated anti-fire protection system.

The field of the invention is protecting devices for starting and controlling electrical installations against fires.

Such devices for starting and controlling electrical installations comprise power electrical conductors provided with switches with separable contacts. The electrical conductors are connected via connecting terminals. One of the main known causes of fire is loosening of the connecting terminals, which causes a rise in temperature in the starter-controller device at the location of the connecting terminals, because the energy stored following this rise in temperature can cause thermal runaway and start a fire. A fire started locally spreads rapidly in the electrical board of the electrical installation and even buildings electrically connected by the electrical installation.

It is known to use thermal surveillance means to monitor any rise in temperature at the location of the connecting terminals.

The document FR2979149 describes a system for thermal surveillance of the connecting terminals of an electrical connection device. The proposed system makes it possible to cut the connections of the electrical connection device if the thermal surveillance means detect the temperature rising above a predetermined threshold. However, in the event of a fire starting, merely cutting the electrical connections does not make it possible to halt the progress of the fire and therefore such a system does not guarantee sufficient safety if a fire has already started.

An objective of the present invention is to remedy this drawback by proposing a protection device that makes it possible to provide enhanced safety should a fire start.

To this end, the invention proposes an anti-fire protection device for a starter-controller device of an electrical installation, the starter-controller device being adapted to be connected to an electrical power conductor, the protection device comprising means for thermal surveillance of the electrical power conductor or conductors adapted to detect the temperature rising above a predetermined threshold.

The anti-fire protection device is adapted to be fixed mechanically to the starter-controller device via at least one mechanical connection member. Said thermal surveillance means comprise at least one temperature sensor, including a portion projecting from a face of the protection device, adapted to sense the temperature at the location of the electrical power conductors of the starter-controller device.

The anti-fire protection device further comprises a cartridge comprising a fire extinguishing agent and at least one injection element, situated on the same face of the protection device as the temperature sensor or sensors, said cartridge being situated inside the protection device, connected to said temperature sensors, the injection element being adapted to inject the fire extinguishing agent toward the electrical power conductors following detection by the temperature sensor of a temperature above the predetermined threshold.

The device of the invention advantageously includes temperature sensors adapted to detect a temperature above a predetermined threshold in the vicinity of the electrical power conductors of the starter-controller device and, thanks to the arrangement of the various elements, advantageously enables rapid injection of an extinguishing agent toward said electrical power conductors.

Accordingly, if a temperature above the predetermined threshold is detected, a fire extinguishing agent is released so as to extinguish any fire that may have started and to prevent the propagation of fire at the location of the connected electrical installation.

The protection device in accordance with the invention may also have one or more of the following features, independently or combined in any technically feasible combination.

It includes a locking piston connected to a locking spring and adapted to be moved when the fire extinguishing agent is released.

It further includes a tripping element adapted to be moved along a predetermined axis by movement of the locking piston and adapted to drive a change of position of a mechanical connection element between the protection device and the starter-controller device.

The mechanical connection element is adapted to assume three distinct positions, including normal operating positions and a locking position, said locking position leading to locking a connection/disconnection control member of the starter-controller device in a disconnection position.

The fire extinguishing agent is a gas or a foam.

The predetermined temperature threshold is 110° C.

The cartridge comprising a fire extinguishing agent is positioned substantially facing the injection element or elements.

In accordance with a second aspect, the invention concerns an anti-fire protection system for an electrical installation, comprising a starter-controller device of the electrical installation and an anti-fire protection device as briefly described hereinabove, the anti-fire protection device being adapted to be fixed to the front of the starter-controller device.

Other features and advantages of the invention will emerge from the following description thereof given by way of illustrative and nonlimiting example and with reference to the appended figures, in which:

In the following description, the same references indicated in different figures represent the same elements.

FIG. 1 is a part-perspective view of a complete anti-fire protection system 1 comprising a starter-controller device 2 adapted to be connected to an electrical installation via electrical conductors not shown in the figure.

Figure 1:
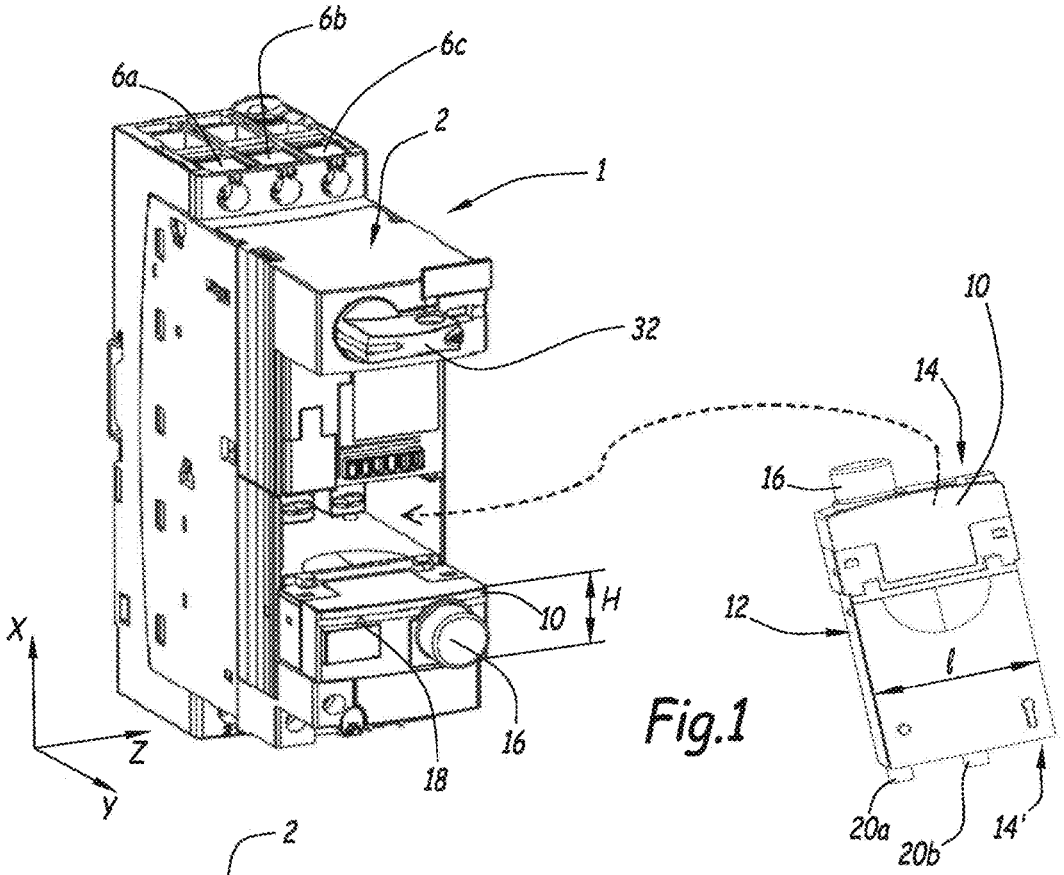
FIG. 1 represents an exploded perspective view of an anti-fire protection system in accordance with one embodiment of the invention.

A spatial system of axes (x,y,z) is shown in FIG. 1.

Figure 2:
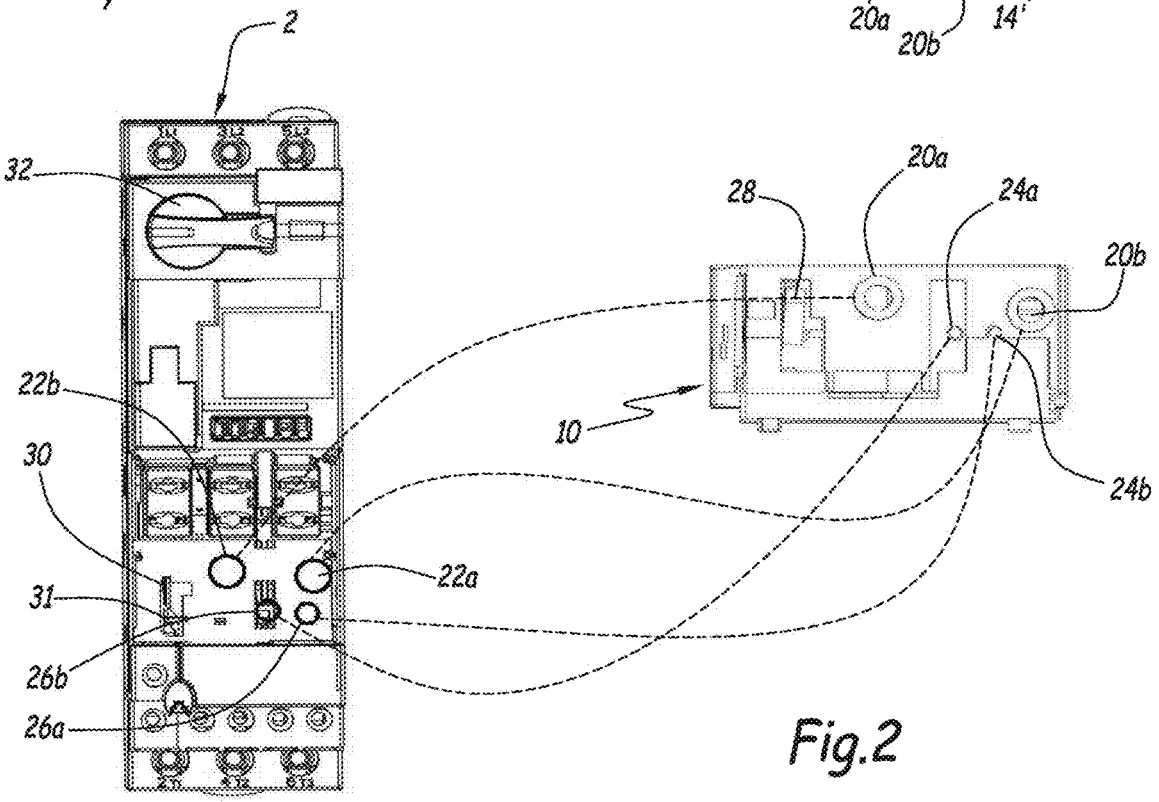
FIG. 2 represents a view of the protection system from FIG. 1, including a view of the bottom of the protection device.

FIG. 2 shows the elements from FIG. 1 as seen along the axis y.

Such a starter-controller device 2 has a function of protecting and controlling single-phase or three-phase motors, notably implementing an overcurrent protection function (or circuit-breaker function) and a power isolation and sectioning function.

Each of the electrical conductors is adapted to be connected to the starter-controller device 2 via a respective connecting terminal 6*a*, 6*b*, 6*c*.

In the example, three connecting terminals are provided for the live electrical conductors carrying a three-phase current.

More generally, a number of connecting terminals between two and four is envisaged.

The system 1 also comprises an anti-fire protection device 10 adapted to be connected to the starter-controller device 2 and to protect that device 2 against a fire starting because of a temperature rising above a predetermined threshold S.

The anti-fire protection device 10 is shown on the one hand as a separate module in the right-hand part of FIG. 1 and mounted on the front of the starter-controller device 2.

The protection device 10 includes a casing 12, preferably of substantially parallelepipedal shape, of narrow width I, substantially equal to the width of the starter-controller device 2, in order to fit it into a location provided in this device, and of low height H, of the order of 20 mm.

The protection device 10 includes on its front face 14 that will be positioned at the front of the starter-controller device 2 a cartridge striker element 16 the function of which, in conjunction with a cartridge 17 containing a fire extinguishing agent which cannot be seen in FIGS. 1 and 2, is described later.

An indicator light 18, adapted to indicate the status of the anti-fire protection device is also present on its front face 14.

On the rear face 14' of the protection device 10, opposite the front face 14, two injection elements 20*a*, 20*b*, which are hollow, for example tubular, enable the injection of a fire extinguishing agent toward the electrical power conductors of the starter-controller device.

The injection elements 20*a*, 20*b* are advantageously spatially situated in the vicinity of the cartridge 17 containing the extinguishing agent, enabling rapid release of that extinguishing agent toward the electrical power conductors of the starter-controller device 2.

The extinguishing agent used is a gas, for example, $CO_2$, for example, or a foam. Generally speaking, any type of fluid or gas electrical fire extinguishing agent may be used.

As shown in FIGS. 1 and 2, the protection device 10 is adapted to be fitted into the starter-controller device 2 and the elements 20*a*, 20*b* for injecting a fire extinguishing agent are intended to be positioned in housings 22*a*, 22*b* of the starter-controller device 2.

The protection device 10 also includes on its rear face 14' temperature sensors 24*a*, 24*b* which, when the protection device 10 is fitted into the starter-controller device 2, are positioned in recesses 26*a*, 26*b* at the location of the electrical power conductors.

The temperature sensors 24*a*, 24*b* are advantageously situated in the vicinity of the injection elements 20*a*, 20*b* at the location of the electrical power conductors and advantageously include a portion projecting from the rear face 14' of the protection device 10.

The temperature sensors 24*a*, 24*b* are therefore able to measure the temperature as close as possible to the electrical power conductors so as to enable rapid tripping as soon as the temperature at the location of the electrical power conductors exceeds a predetermined threshold value and the injection elements 20*a*, 20*b* are adapted to inject the extinguishing agent directly at the location of the electrical power conductors where the overtemperature has been detected.

The temperature sensors 24*a*, 24*b* are electrically connected to the striker element 16 so as to enable its tripping and the release of the fire extinguishing agent as soon as the temperature exceeds a predetermined temperature threshold S.

The temperature threshold S is preferably 110° C.

The casing 12 of the protection device 10 includes at least one mechanical connection member 28 that is adapted to make a mechanical connection via a connection interface 30 of the starter-controller device 2, enabling control of a lock mechanism allowing opening and closing of the electrical connections of the electrical power conductors in their respective connecting terminals.

The mechanical connection element 28 is mobile in the slot 31 of the starter-controller device and, as described hereinafter, is able to assume three distinct ON, OFF and TRIP positions.

In the proposed system 1, a change of position of the mechanical connection element 28 from an electrical connection position to an electrical disconnection position makes it possible to modify the position of the connection/disconnection (on/off) control member 32 of the starter-controller device 2.

A change in position of the mechanical connection element 28 therefore makes it possible to change the electrical connection state of the conductors. This mechanical connection element 28 is also an electrical connection control element.

Moreover, via the mechanical connection element 28, the protection device 10 makes it possible to maintain a locked disconnection position (TRIP position) following detection of a fire starting.

Figure 3:
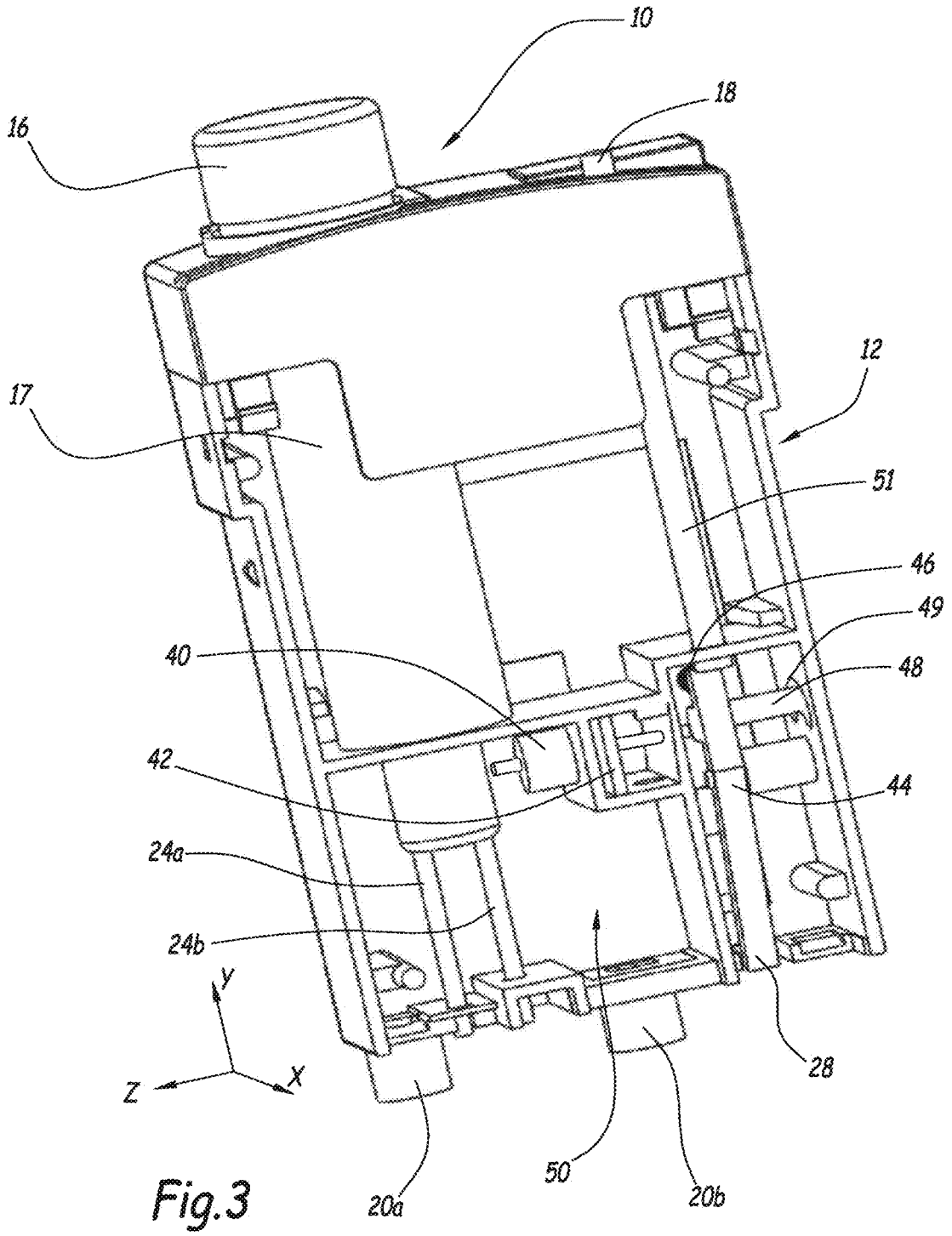
FIG. 3 shows in detail an anti-fire protection device in accordance with one embodiment of the invention.

FIG. 3 shows in cross section a protection device 10 in accordance with one embodiment of the invention.

In addition to the elements already described hereinabove, the protection device 10 includes a locking spring 40 and a locking piston 42, a tripping element 44, a tripping spring 46 and a resetting lever 48. The resetting lever is accessible via a lateral wall of the casing 12, through a slot 49 piercing this lateral wall.

If the sensors 24*a*, 24*b* detect the temperature at the location of the power conductors rising above the predetermined temperature threshold, the cartridge striker 16 is triggered and pierces the cartridge 17, which leads to the release of the extinguishing agent toward the injection elements 20*a*, 20*b*.

The cartridge 17 is advantageously positioned substantially facing the injection elements 20*a*, 20*b*, in close spatial proximity to them, preferably of the order of 15 mm.

Following release of the extinguishing agent by striking the cartridge 17, this extinguishing agent is therefore fed quasi-immediately to the location of the electrical power conductors of the starter-controller device 2.

The anti-fire protection system provided by the anti-fire protection device 10 is very highly responsive.

The extinguishing agent, foam or gas, also fills the hollow spaces 50 of the protection device, which causes the locking piston 42 to move along the axis z.

Following this movement, the tripping element 44 is released and driven in rotation about the axis z by the action of the tripping spring 46.

The movement of the tripping element 44 modifies the position of the mechanical connection element 28 in translation along the axis x and also the position of the resetting lever 48.

The protection device 10 further includes a light pipe 51 the colour of which is modified as a function of the position of the tripping element 44 and the end 18 of which visible on the front face 14 of the casing 12 of the protection device 10 indicates the status of the safety device. The end 18 of the light pipe 51 therefore forms an indicator light showing the status of the protection device 10.

For example, the colour black indicates normal operation and the colour red tripping of the protection mechanism following detection of a temperature above the temperature threshold.

FIGS. 4 to 8 show the operation of the protection device 10 in more detail.

Figure 4:
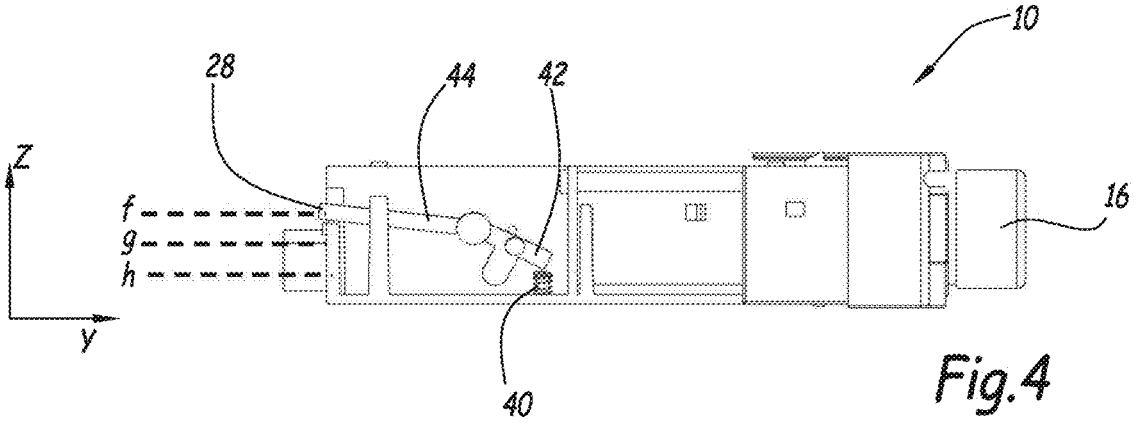
FIG. 4 is a view in cross section of the anti-fire protection device in a first mode of operation.
Figure 7:
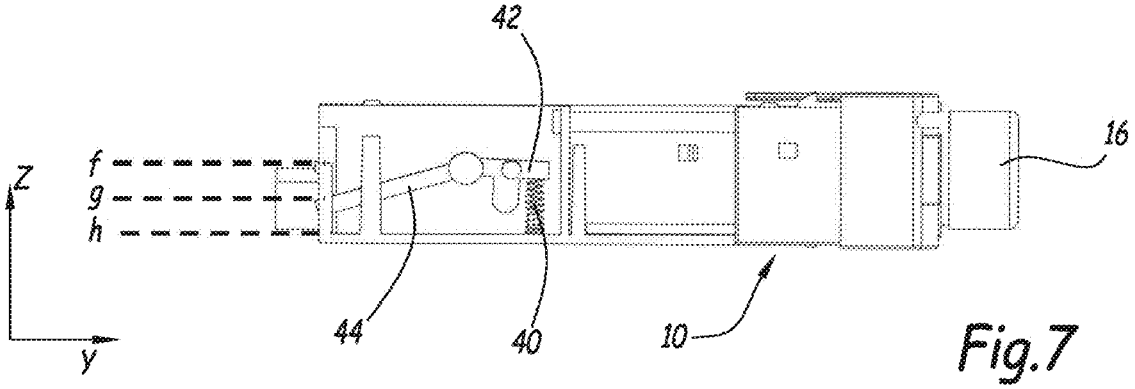
FIG. 7 is a view in cross section of the anti-fire protection device in the second mode of operation.

FIGS. 4 and 7 show the protection mechanism of the anti-fire protection device from the side in two modes of operation.

Figure 5:
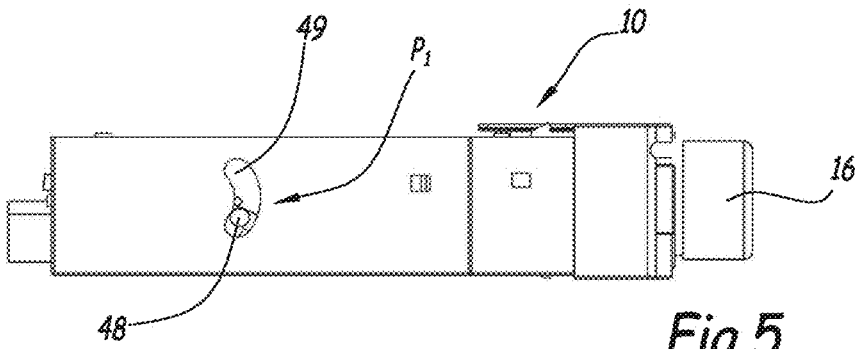
FIG. 5 is a side view of the anti-fire protection device in the first mode of operation.
Figure 6:
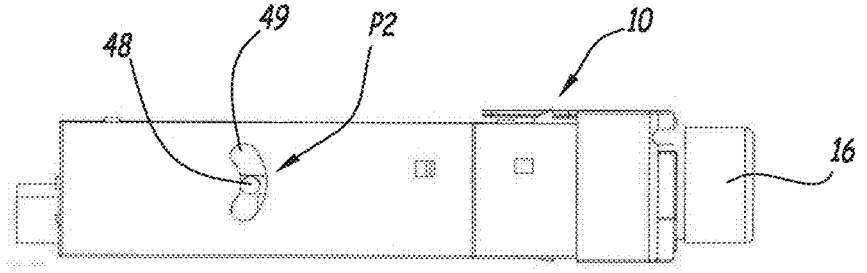
FIG. 6 is a side view of the anti-fire protection device in a second mode of operation.

FIGS. 5 and 6 are side views of the protection device 10 showing the slot 49 and the corresponding position of the resetting lever 48.

Figure 8:
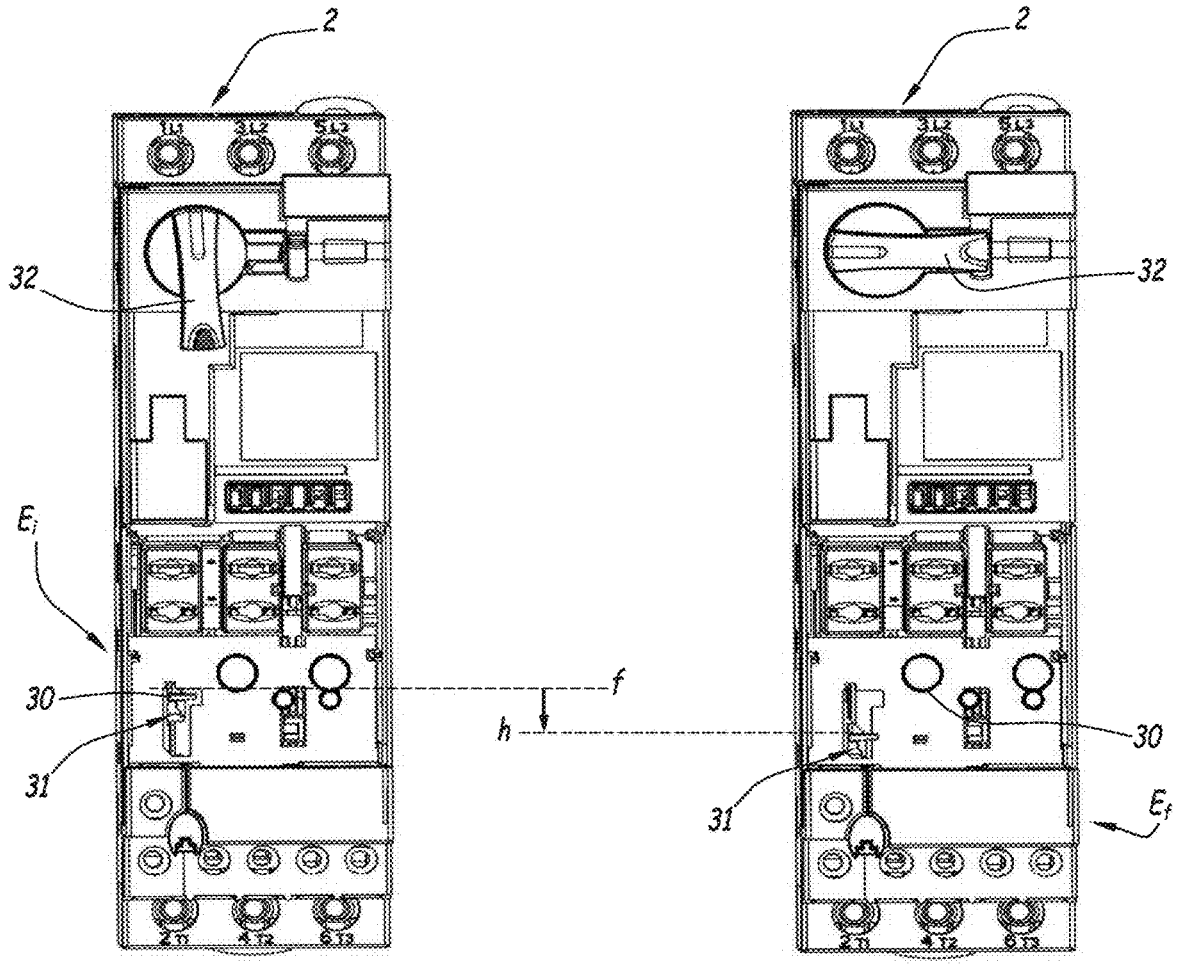
FIG. 8 shows the operation of the starter-controller device when subject to the action of the anti-fire protection device in two different states.

FIG. 8 shows the starter-controller device in the plane x-z and the position of the connection interface 30 receiving the mechanical connection element 28 in the slot 31 depending on the pre-tripping state (Ei) or after tripping state (Ef) of the protection mechanism of the protection device 10.

FIG. 4 shows the operation of the protection device 10 when the sensed temperatures are below the temperature threshold and the mode of operation is therefore normal.

Three positions of the connection element 28, which is the end of the tripping element 44, are shown, marked f, g and h and respectively corresponding to the ON, OFF and TRIP positions of the lock mechanism.

In the mode of operation before tripping, the locking piston 42 is in a first rest position and the locking spring 40 is compressed. The tripping element 44 is in a raised position, in which it is held by the tripping spring 46. The connection element is in position f.

The resetting lever 48 is in a first position P1, which is a low position, as shown in FIG. 5.

If the temperature rising above the predetermined temperature threshold is detected the locking spring 40, actuated by the released extinguishing agent, moves the locking piston 42 along the axis z.

The movement of the locking piston 42 drives the movement of the tripping element 44, which goes from position f or g to position h.

In parallel with this, the resetting lever 48 goes to position P2, as shown in FIG. 6.

The position of the mechanical interface 30 is modified by the change of position of the electrical connection control connection element 28 of the anti-fire protection device and the (on/off) control member 32 of the starter-controller device 2 is locked in the OFF position (see FIG. 8, operating state Ef), and therefore in the position disconnecting the electrical power conductors.

In parallel with this, the light pipe 51 and the indicator light 18 indicate, by a change of colour, tripping of the safety system.

Thanks to the protection device 10, the power conductors are therefore open circuit and the resetting function is locked. Manual resetting is possible afterwards.

The protection device 10 may advantageously operate several times after resetting, and after changing the cartridge 17 containing an extinguishing agent, it is not limited to a single use.

The anti-fire protection device in accordance with the invention advantageously makes it possible to extinguish rapidly a fire starting at the location of the connecting terminals or the electrical power conductors of a starter-controller device of an electrical installation, at the same time as effecting an electrical disconnection and remaining in the disconnected position.

The invention claimed is:

1. An anti-fire protection device for a starter-controller device of an electrical installation, the starter-controller device being adapted to be connected to at least one electrical power conductor, the protection device comprising:

a thermal surveillance device configured to perform thermal surveillance of the at least one electrical power conductor adapted to detect the temperature rising above a predetermined threshold, wherein the thermal surveillance device is adapted to be fixed mechanically to the starter-controller device via at least one mechanical connection member, wherein said thermal surveillance device includes at least one temperature sensor, including an exposed end portion projecting from a rear face of the protection device and facing an interior rear surface of the starter-controller device, adapted to sense a temperature at the exposed end portion projecting from the rear face at the level of the electrical power conductors of the starter-controller device, wherein said thermal surveillance device includes a cartridge comprising a fire extinguishing agent and at least one injection element, situated on the same rear face of the protection device as the at least one temperature sensor, said cartridge being situated inside the protection device, connected to said at least one temperature sensor, the at least one injection element and the at least one temperature sensor both face the interior rear surface of the starter-controller device in a same direction, where the at least one temperature sensor is configured to be inserted into at least one respective recess disposed on the interior rear surface of the starter-controller device, and the at least one injection element is configured to be inserted into at least one respective housing disposed on the interior rear surface of the starter-controller device, and wherein the injection element is adapted to inject the fire extinguishing agent towards the electrical power conductors following detection by the temperature sensor, of a temperature above the predetermined threshold.

2. The anti-fire protection device according to claim 1, comprising a locking piston connected to a locking spring and adapted to be moved when the fire extinguishing agent is released.

3. The anti-fire protection device according to claim 2, comprising a tripping element adapted to be moved along a predetermined axis by movement of the locking piston and adapted to drive a change of position of a mechanical connection element between the protection device and the starter-controller device.

4. The anti-fire protection device according to claim 3, wherein the mechanical connection element is adapted to assume three distinct positions, including normal operating positions and a locking position, said locking position leading to locking a connection/disconnection control member of the starter-controller device in a disconnection position.

5. The anti-fire protection device according to claim 1, wherein said fire extinguishing agent is a gas or a foam.

6. The anti-fire protection device according to claim 1, wherein said predetermined temperature threshold is 110° C.

7. The anti-fire protection device according to claim 1, wherein the cartridge comprising a fire extinguishing agent is positioned substantially facing the injection element or elements.

8. The anti-fire protection system for an electrical installation, comprising a starter-controller device of the electrical installation and an anti-fire protection device according to claim 1, the anti-fire protection device being adapted to be fixed to the front of the starter-controller device.

9. An anti-fire protection device for a starter-controller device of an electrical installation, the starter-controller device being adapted to be connected to at least one electrical power conductor, the protection device comprising:

a thermal surveillance device configured to perform thermal surveillance of the at least one electrical power conductor adapted to detect the temperature rising above a predetermined threshold, wherein the thermal surveillance device is adapted to be fixed mechanically to the starter-controller device via at least one mechanical connection member, wherein said thermal surveillance device includes at least one temperature sensor, including a portion projecting from a rear face of the protection device, adapted to sense a temperature at the level of the electrical power conductors of the starter-controller device, wherein said thermal surveillance device includes a cartridge comprising a fire extinguishing agent and at least one injection element, situated on the same rear face of the protection device as the at least one temperature sensor, said cartridge being situated inside the protection device, connected to said at least one temperature sensor, wherein the injection element is adapted to inject the fire extinguishing agent towards the electrical power conductors following detection by the temperature sensor, of a temperature above the predetermined threshold, and the anti-fire protection device further comprising a locking piston connected to a locking spring and adapted to be moved when the fire extinguishing agent is released.

* * * * *